United States Patent [19]

Holm

[11] 4,338,594

[45] Jul. 6, 1982

[54] TROLLEY CHECK-OUT MONITORING SYSTEM

[76] Inventor: Lars-Erik Holm, Pollenvägen 12, 722 31 Västerås, Sweden

[21] Appl. No.: 207,089

[22] Filed: Nov. 14, 1980

[51] Int. Cl.[3] ..... G08B 13/18

[52] U.S. Cl. ..... 340/568; 340/52 D; 340/556; 340/673

[58] Field of Search ..... 340/52 R, 52 D, 63, 340/524, 528, 555, 556, 557, 568, 572, 574, 600, 673, 674, 675, 676

[56] References Cited

U.S. PATENT DOCUMENTS 3,457,423 7/1969 Gravely ..... 340/600

3,725,894 4/1973 Geisler ..... 340/568

*Primary Examiner*—Alvin H. Waring

*Attorney, Agent, or Firm*—Hammond & Littell, Weissenberger and Muserlian

[57] ABSTRACT

A monitoring system for shopping trolleys of the kind used in self-service stores, including a basket for the goods and having at least one support surface below the basket and which is not normally visible to the check-out operator and provides a transmitter/receiver to detect an article on such a lower support surface and a further transmitter/receiver disposed at a lower level, to block operation of the transmitter/receiver in response to the legs of the customer, parts of the trolley running gear and the like and a device to provide a signal in response to operation of the transmitter/-receiver.

3 Claims, 4 Drawing Figures

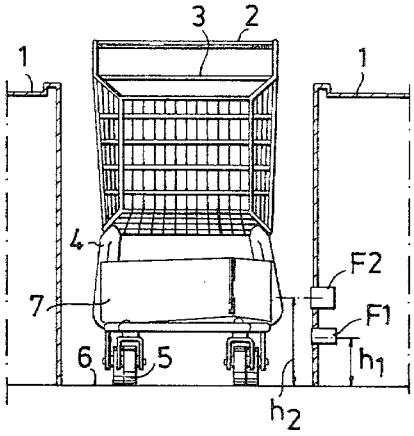
Fig. 1
Fig. 2
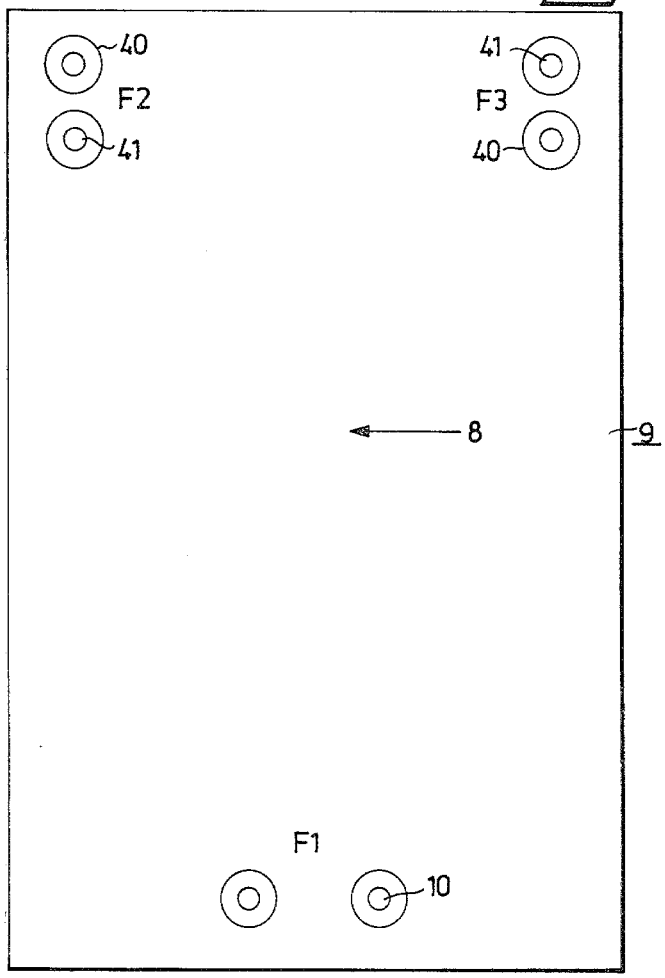

TROLLEY CHECK-OUT MONITORING SYSTEM

This invention relates to a monitoring system for shopping trolleys of the kind used in self-service stores, including a basket for the goods and having at least one support surface below the basket and which is therefore not normally visible to the check-out operator.

U.S. Pat. No. 3,725,894 describes a monitoring system for detecting articles disposed on such a lower support surface as the trolley passes through the check-out. In this known system, the trolley has a light-reflecting element which reflects a substantial proportion of light from a source back to the source. Sensing means are provided in order to direct a beam of light towards the reflecting element and to produce a signal only when the intensity of light reflected back to the sensing means exceeds a certain value. Scanning means are also provided and are operable when actuated by the output signal from said sensing means in order to scan the trolley contents as the trolley passes through the sensing zone. If there is an article on the bottom support surface the check-out operator's attention is draw to it by a signal system co-operating with the scanning means.

It has been found in practice that this known and similar systems very often give unnecessary or false alarms, due to the structure of the trolley itself, particularly upright members forming part of the trolley running gear, the customer's legs, and so on. Consequently, check-out operators tend to disregard signals given by the system.

The object of the invention is so to devise a monitoring system in which only the level of the trolley at which a lower support surface may be expected to be found is scanned and the operator's attention is not unnecessarily distracted.

To this end, the invention provides at least two transmitter/receivers to detect/indicate an article on said lower surface and that a further transmitter/receiver is arranged at a lower level than, and between said, first mentioned transmitters/receivers to block operation of the first mentioned transmitters/receivers in response to the legs of a passing customer, parts of the trolley gear and the like, and a device controlled by first mentioned transmitter/receiver in order to provide a signal giving evidence of an article on said lower surface.

One example of a monitoring system according to the invention will be described below with reference to the accompanying drawings in which:

FIG. 1 shows a monitoring zone with a trolley passing therethrough;

FIG. 2 shows three photoelectric cells used in the monitoring system;

Figure 3:
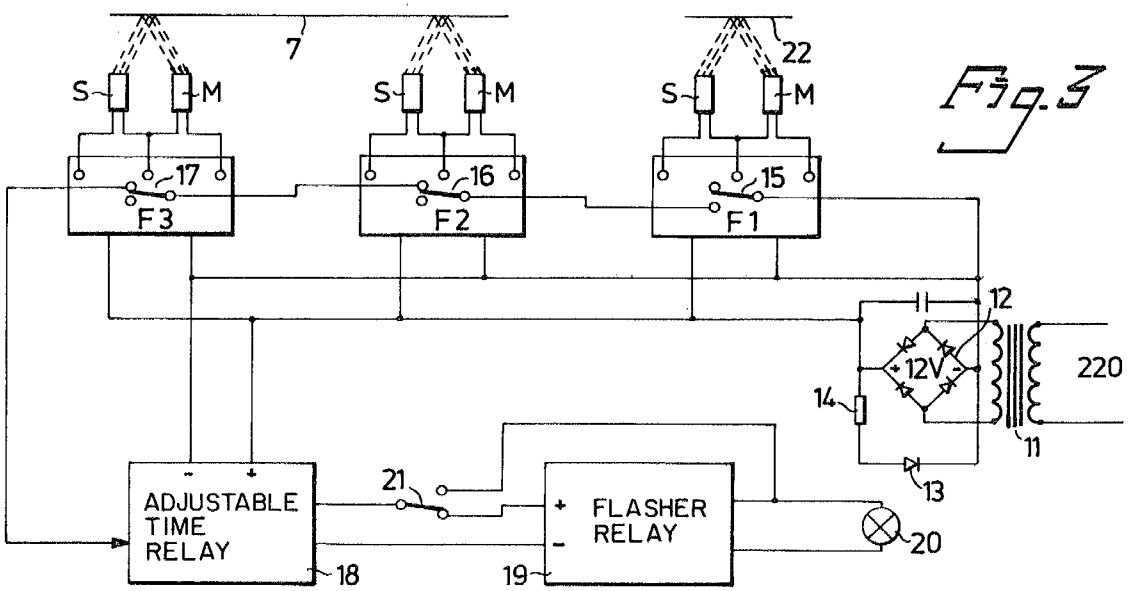
FIG. 3 is a circuit diagram of the monitoring system.

FIG. 1 shows a trolley 3 as it passes through a passage between two check-out counters 1. Reference 2 denotes the handle bar of the trolley, reference 4 structural members and 5 trolley wheels. An upper transmitter/-receiver F2 is disposed at a height h2 above the floor 6 while a lower transmitter/receiver F1 is disposed at height h1 above the floor. An article 7 is shown on a lower support surface of the trolley.

Referring to FIG. 2, where the direction of travel of the trolley is shown by arrow 8, there are in fact two upper transmitter/receiver devices F2, F3. Each of the devices F1, F2 and F3, is a photo-cell device comprising a transmitter and a receiver and together they form a unit 9, which also contains other electronic components. F3 and F2 are disposed at level h2 (see FIG. 1), and F1 is at level h1, normally immediately above wheels 5. The light from each transmitter is a directional frequency-modulated infra-red light. The vertical distance between F3/F2 and F1 is advantageously about 146 mm, and the horizontal distance between F3 and F1 about 22 mm, the centre-to-centre distance between F2 and F3 about 80 mm, the distance between the transmitter and receiver of F1 is about 23 mm, the distance between the centre of F2 and F3 and the edge of the unit 9 is about 16 mm, and the centre of the F1 device from the said edge about 38 mm. The values of h1 and h2 in FIG. 1 correspond respectively approximately to the position of the wheel holders and a height somewhat above the bottom trolley support surface. F1 is therefore situated between F2 and F3 but as a lower level. The openings 10 of F1 are about 6 mm in diameter.

FIG. 3 shows the devices F1–F3 with their transmitters S and receivers M. The surface of the article is denoted by reference 7. Reference 22 is the surface of a human leg, for example. Current is produced from the 220 V mains via a transformer 11 and a rectifier unit 12 with voltage stabilization, to give 12 V d.c. supply. An LED (e.g. green) with a protective resistor 14 indicates when the monitoring system is switched on. F1–F3 are fed at 12 V by the rectifier unit and each has a contact system 15, 16 and 17 respectively. These contacts change on each interruption of the beam from the particular transmitter S to the surface 7 or 22 and back to the respective receiver M. The devices F1–F3 control an adjustable time relay 18, which controls a flasher relay 19. The latter feeds a flasher warning light 20. As soon as F2 and F3 are actuated, time relay 18 is operated. The flashing effect may be avoided by means of a switch 21, so that the lamp 20 will light with a permanent, e.g. red, light in the event of an alarm. The lamp 20 may be replaced by or combined with an acoustic alarm system.

Figure 4:
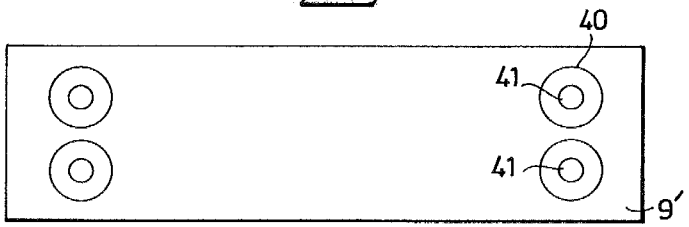
FIG. 4 shows two of the transmitter/receivers combined to form a unit.

FIG. 4 shows how the transmitters and receivers are combined in a box 9′ adapted to be inserted into the unit 9. Box 9′ has apertures 40 of about 6 mm in diameter, while the apertures of the transmitter/receivers 41 are much smaller, about 3–4 mm. The dimensions are selected to give an optimum narrow dispersion angle for the light so that F2/F3 do not interfere with one another.

The monitoring system is thus constructed on the basis of three photoelectric cells which are combined with one another, and in which two series-connected devices F2 and F3 "sight" an article 7 on the lower support surface of the trolley. When an article has been detected by both F2 and F3 a warning signal is given. To obviate false alarms due to circumstances associated with the trolley running gear, the photoelectric cells are built into a box 9′ as indicated above, the box being so designed that the photoelectric cells and the transmitters do not interfere with one another (FIG. 4). The third photo-cell device F1 is connected in series with the other two in order to avoid indicating insignificant details, e.g. a customer's legs. To this end, F1 is disposed between the bottom edge of the trolley support surface and the floor and is normally closed (i.e. the contacts open when the device F1 detects something) whereas the contacts of F2 and F3 are normally open.

Time relay 18 also incorporates a delay feature to cover the case in which a trolley passes rapidly through the monitoring zone.

An alarm signal is generated if both F2 and F3 are operated. However, nothing happens if F1, F2 and F3 are operated simultaneously. The coupling interval is timed for reflection of the pulsating infra-red light or for the sensitivity of the monitoring system so that details (e.g. a customer) behind a trolley do not result in an alarm.

I claim:

1. A monitoring system for shopping trolleys of the kind used in self-service stores, having a basket for the goods and at least one support surface below said basket which is not normally visible to the sitting checkout operator, wherein the system comprises at least two transmitters/receivers to detect/indicate an article on said lower surface and a further transmitter/receiver arranged at a lower level than, and between said first-mentioned transmitters/receivers to block operation of the first-mentioned transmitters/receivers in response to the legs of a passing customer, parts of the trolley gear and the like, and a device controlled by first-mentioned transmitter/receiver in order to provide a signal giving evidence of an article on said lower surface, said transmitters arranged to emit a frequency-modulated infrared light in the form of a beam, which is reflected by said article and details back towards the respective receivers.

2. A monitoring system according to claim 1, wherein two transmitters/receivers are combined into a unit.

3. A monitoring system according to claim 2, wherein the openings of the unit are larger or substantially larger than the apertures of the transmitters/receivers.

* * * * *